US010465148B2

(12) United States Patent
Guerino

(10) Patent No.: US 10,465,148 B2
(45) Date of Patent: Nov. 5, 2019

(54) POST-BREW COFFEE GROUND PRODUCTS

(71) Applicant: Mark Guerino, Brooklyn, NY (US)

(72) Inventor: Mark Guerino, Brooklyn, NY (US)

( * ) Notice: Subject to any disclaimer, the term of this patent is extended or adjusted under 35 U.S.C. 154(b) by 72 days.

(21) Appl. No.: 15/604,782

(22) Filed: May 25, 2017

(65) Prior Publication Data

US 2017/0340555 A1 Nov. 30, 2017

Related U.S. Application Data

(60) Provisional application No. 62/341,093, filed on May 25, 2016.

(51) Int. Cl.
*C11D 9/38* (2006.01)
*C11D 13/16* (2006.01)
*C11D 13/10* (2006.01)

(52) U.S. Cl.
CPC ..... *C11D 9/38* (2013.01); *C11D 13/10* (2013.01); *C11D 13/16* (2013.01)

(58) Field of Classification Search
None
See application file for complete search history.

(56) References Cited

U.S. PATENT DOCUMENTS

2015/0093446 A1* 4/2015 Muller ..... A61K 8/97 424/535
2016/0089325 A1* 3/2016 Perkins ..... A61Q 9/02 424/64

* cited by examiner

*Primary Examiner* — Necholus Ogden, Jr.
(74) *Attorney, Agent, or Firm* — Ricky Lam

(57) ABSTRACT

Methods and systems to manufacture a soap bar comprising post-brew coffee particles are disclosed. A soap bar may comprise multiple post-brew coffee ground particle sizes to take advantage of the benefits associated with each size. For example, the soap bar may comprise espresso grinds (0.20 mm), regular grinds (1.0 mm), and/or coarse grinds (1.5 mm). A saponified fat base, e.g., a milk soap base, a plant oil base, and/or an animal fat base may be obtained and heated to a consistency. Collected post-brew coffee grounds may then be added. The coffee grounds may be anywhere from 1% to 65% of the total weight of the final product, depending on the desired soap quality. The final soap product may comprise coffee ground positive and coffee ground negative layers or portion, or the coffee grounds may be evenly dispersed throughout the product.

10 Claims, 10 Drawing Sheets

POST-BREW COFFEE GROUND PRODUCTS

CLAIMS OF PRIORITY

This patent application is a continuation-in-part and claims priority from:

(1) U.S. provisional patent application No. 62/341,093, entitled 'Post-brew coffee ground products', filed May 25, 2016.

FIELD OF TECHNOLOGY

This disclosure relates generally to techniques for manufacturing products comprising post-brew coffee grounds.

BACKGROUND

Coffee, and particularly coffee grounds, is believed to comprise enzymes that may aid in neutralizing odors, detoxifying and cleansing skin, which in turn may help reduce acne and other skin conditions, such as eczema. In addition, the natural caffeine and polyphenol present in coffee is believed to have anti-inflammatory properties, and may allow skin to have an anti-oxidizing effect, which may maintain the humidity of the skin, lubricate the skin, allow the skin to be stretched taut and prevent it from chapping. They are also known to be able to stimulate the skin to decompose fat. Because coffee has a plurality of beneficial compositions and specific functions, it can also be applied to care products.

However, a large amount of post-brew coffee grounds are thrown away on a daily basis. Coffee is a natural biodegradable substance that will not pollute the environment. There is a need to utilize post-brew coffee grounds for its therapeutic effects.

SUMMARY

Disclosed are methods and systems for manufacturing post-brew coffee ground products.

In one aspect, the present invention discloses a system and a method to produce a soap bar that comprises one or more coffee particle sizes. Coffee particle size may range from a whole bean being approximately 6.0 mm wide, and an espresso grind comprising approximately 0.20 mm width. In an exemplary embodiment, espresso grinds are used exclusively in the soap bars because of its abundance, though a smaller particle size may be used, such 0.01 mm to 0.20 mm. A small coffee particle size may be advantageous in the implementation of the present invention due to its low moisture content, which may not require an additional water reduction step to prepare, e.g., baking, and its light texture may provide a soothing sensation on human skin. In another embodiment, a large coffee particle size may be exclusively used in the soap bar, such as, e.g., 0.21 mm to 6.0 mm. A large coffee particle size may be desirable due to its higher retention of natural oils and compounds that small particles tend to lose during the brewing process. However, if the size of the particles is too large, the skin of the user may be scratched; and if the size is too small, the exfoliating effect is decreased and there may be no granular sensation. In yet another embodiment, a soap bar may comprise multiple post-brew coffee ground particle sizes to take advantage of the benefits associated with each size. For example, the soap bar may comprise espresso grinds (0.20 mm), regular grinds (1.0 mm), and/or coarse grinds (1.5 mm).

In another one aspect, the method may comprise a melt-and-pour process of manufacturing coffee-ground-infused soap bars. A saponified fat base, e.g., a milk soap base, a plant oil base, and/or an animal fat base may be obtained and heated to a consistency. Examples of milk soap bases include goat's milk, cow's milk, camel's milk, coconut milk, and almond milk. Examples of plant oil bases include avocado oil, cinnamon oil, coconut oil, olive oil, sunflower oil, and nutmeg oil. An example of an animal fat base include a lard soap base. In an exemplary embodiment, the melt-and-pour soap base may comprise the ingredients: glycerin, *elaeis guineensis* oil (palm oil), *cocus nucifera* oil (coconut oil), lauric acid, sodium hydroxide, sodium lauryl sulfate, sorbitol, triethanolamine, sodium chloride (table salt), goat milk, ethylenediaminetetraacetic acid (EDTA), and/or titanium dioxide.

Prior to heating, if the soap base is in solid form, such as a cube, dividing the cube into smaller equal or almost equal portions may increase heating rate due to the increase in surface area to volume ratio of the base, and may facilitate even heating. The soap base may also come in powder form, which may not require prepping. The heating may be performed in a container placed in direct contact with a heating apparatus, e.g. in a pot on a stove, or in a convection oven, such as a microwave oven. If the former is used, continual stirring of the soap base may be required for even heating and to prevent burns, which may have undesirable qualities. If a convection oven is used, stirring should be performed in intervals, such as every 15 seconds or 30 seconds, such that the soap base is evenly heated.

After the saponified fat base reaches a consistency, collected post-brew coffee grounds may be added. The coffee grounds may be anywhere from 1% to 65% of the total weight of the final product, depending on the desired soap quality. A higher amount of coffee grounds may allow for a shorter soap final product drying and hardening time, but may reduce cleansing effectiveness and increase exfoliation. The opposite is also true, whereby a lower amount of coffee grounds may require a longer soap final product drying and hardening phase, but may increase cleansing effectiveness by allowing the oils and minerals inside the soap to have a greater effect, while exfoliation is decreased. If a final soap product comprising coffee ground positive and coffee ground negative layers or portions is desired, the coffee grounds may be 40% or less of the total weight of the final product when mixed with the soap base, otherwise the portions may separate poorly. The consistency may be achieved when the soap base reaches a constant temperature between 100 degrees Fahrenheit and 160 degrees Fahrenheit such that the base is hot enough to facilitate the distribution of the coffee particles without burning the particles. If even distribution of the coffee particles within the base is desired, continual stirring of the base may be employed. Optionally, a suspension base may be added to maintain the even distribution by suspending the particles within the melted base. This may be particularly useful when the base is poured into a mold and is at rest to harden into a final product.

In some aspects, alternative methods of infusing the post-brew grounds with the melted base may be provided. For example, if the final soap product is desired to have the effect of layers, wherein different portions of the product comprise different texture qualities, the melted soap base and coffee grounds may not be stirred and may be allowed to settle such that the coffee grounds accumulate towards the lower portion, leaving the top portion with minimal particle contamination. The portions may be divided into equal or roughly equal parts. In other aspects, the portions may be unequal parts, such as having a volume ratio of 1:2, 1:3, or 1:4. The settling of the particles may be achieved by keeping the temperature constant for approximately 10 minutes to 30 minutes. The temperature is ideally on the higher end of the range, such as, e.g. 120 degrees Fahrenheit to 160 degrees Fahrenheit, such that there is adequate enthalpy and entropy in the system to facilitate movement of the particles towards the bottom portion.

In another aspect, the process of manufacturing post-brew coffee ground soap products may comprise a "cold process" method. The method may require mixing a lye (sodium hydroxide or potassium hydroxide) solution with a lipid (oil and/or animal fat and/or milk) to induce saponification, which is an exothermic chemical reaction that produces soap, glycerin, and heat as byproducts. The lye solution may comprise distilled water and optionally the aforementioned milk. The water and/or milk may be chilled or frozen prior to adding lye to reduce the chance for a violent chemical reaction. Milk may be obtained in powder form, whereby a mixture with distilled water may be required prior to chilling.

In yet another aspect, the present invention discloses a system and method of making whipped soap. The whipped soap product may be of a creamy texture and may comprise an even distribution of post-brew coffee grounds. The coffee grounds may be regular sized grounds and/or espresso grounds; however, regular sized grounds are preferred due to its moisture content (unlike with soap bars above), which allows the method to require less water by economically utilizing the water already present in the collected grounds.

In yet another aspect, the present invention may disclose a system and a method for making a candle comprising post-brew coffee grounds. The post-brew coffee grounds may be infused with candle wax material and may be positioned at a lower portion of the candle. In other embodiments, the coffee grounds are not infused with the candle wax, and are simply positioned below the wax inside a container. The coffee grounds may provide the benefit of acting as a flame retardant to safely put out a flame front, and may aid in the cleaning of the container in which it is disposed. The container may then be re-used.

In a further aspect, the present invention discloses a system and a method for making a concreate table from post-brew coffee grounds and concrete.

BRIEF DESCRIPTION OF THE DRAWINGS

Example embodiments are illustrated by way of example and are not limited to the figures of the accompanying drawings, in which, like references indicate similar elements.

DETAILED DESCRIPTION

Although the present embodiments have been described with reference to specific example embodiments, it will be evident that various modifications and changes may be made to these embodiments without departing from the broader spirit and scope of the various embodiments. In addition, the components shown in the figures, their connections, couples, and relationships, and their functions, are meant to be exemplary only, and are not meant to limit the embodiments described herein.

The present invention relates to a system and a method for producing molded products using coffee grounds. The method may comprise collecting post-brew coffee grounds, and then drying (if necessary) and mixing with a melted saponified fat base. The mixture may be poured into one or more molds to settle and harden into a final soap product. The mold may be of any size. If a large mold is used, e.g., 12 inches by 12 inches by 3 inches, then the final soap product may be cut into smaller usable pieces.

Coffee grounds may come in a variety of sizes. Generally, smaller coffee particles comprise a larger surface area to volume ratio, such that there is a greater absorption area for hot water to act upon, and greater liberation of carbon dioxide gas byproduct. Smaller particles also comprise shorter distances from the center of each particle and may increase the extraction rates of oils, soluble and other flavor compounds.

The process of reducing whole coffee particles into smaller pieces is called "grinding" and can be done using a number of methods; however, the most common types of grinder are blade and burr grinders. A blade grinder may be a mechanical device comprising one or more sharp surfaces that revolves around a center axis used to cut particles. A burr grinder may also be a mechanical device, wherein coffee particles are reduced between two grating abrasive surfaces separated by a distance set by a user. The distance may coincide with the final particle size such that a large distance yields a larger final particle size than that which a small distance may yield.

Figure 1:
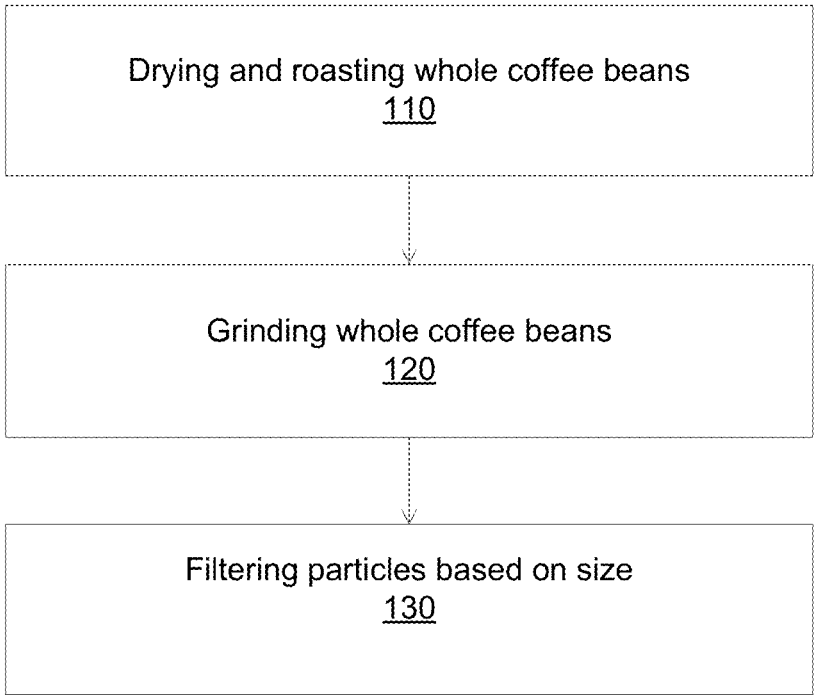
FIG. 1 is a flow chart of a method for grinding whole coffee beans, according to at least one embodiment.

FIG. 1 is a flow chart of a method for grinding whole coffee beans, according to at least one embodiment. Operation 110 dries and roasts whole coffee beans to remove water content. Operation 120 may grind the beans into smaller coffee particles. Grinding of the beans may be employed by a variety of techniques. Operation 130 filters the grounded particles based on size.

Several factors that may influence how coffee particles behave during the grinding process, including moisture content, degree of roast, and degree of brittleness. Typically, roasted beans that have been subjected to water quenching tend to be softer than air cooled ones. As a result, water quenched beans tend to distort unevenly during grinding and tend to produce inconsistent grind particles. Beans of lighter roasts may be more pliable and tenacious than darker roasted coffee. The greater loss of moisture content in dark roasts may make beans more brittle and as such, produces a greater number of finer particles than lighter roasts. In addition, altitude may also affect the way the bean will grind, since beans grown at a higher altitude tend to be denser than those grown at a lower altitude.

In at least one embodiment, the present invention discloses a system and a method to produce a soap bar that comprises one or more coffee particle sizes. Coffee particle size may range from a whole bean being approximately 6.0 mm wide, and an espresso grind comprising approximately 0.20 mm width. In an exemplary embodiment, espresso grinds are used exclusively in the soap bars because of its abundance, though a smaller particle size may be used, such 0.01 mm to 0.20 mm. A small coffee particle size may be advantageous in the implementation of the present invention due to its low moisture content, which may not require an additional water reduction step to prepare, e.g., baking, and its light texture may provide a soothing sensation on human skin. In another embodiment, a large coffee particle size may be exclusively used in the soap bar, such as, e.g., 0.21 mm to 6.0 mm. A large coffee particle size may be desirable due to its higher retention of natural oils and compounds that small particles tend to lose during the brewing process. However, if the size of the particles is too large, the skin of the user may be scratched; and if the size is too small, the exfoliating effect is decreased and there may be no granular sensation. In yet another embodiment, a soap bar may comprise multiple post-brew coffee ground particle sizes to take advantage of the benefits associated with each size. For example, the soap bar may comprise espresso grinds (0.20 mm), regular grinds (1.0 mm), and/or coarse grinds (1.5 mm).

Figure 2A:
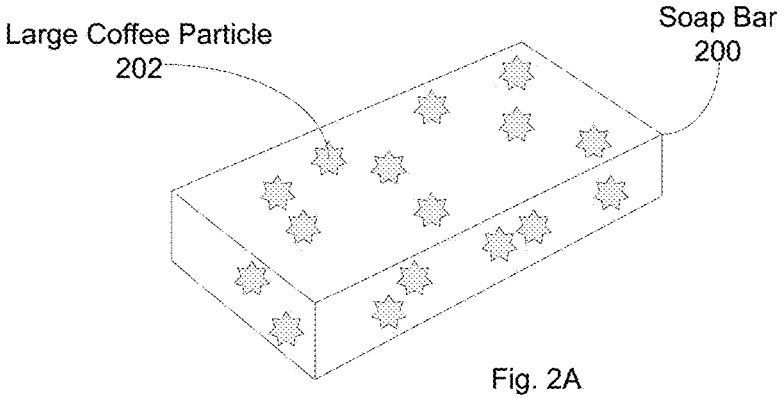
FIGS. 2A-C illustrate soap bars comprising various particle size configurations, according to at least one embodiment.
Figure 2B:
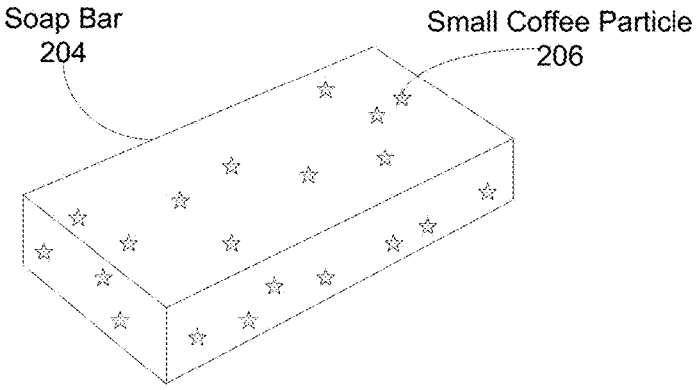
Figure 2C:
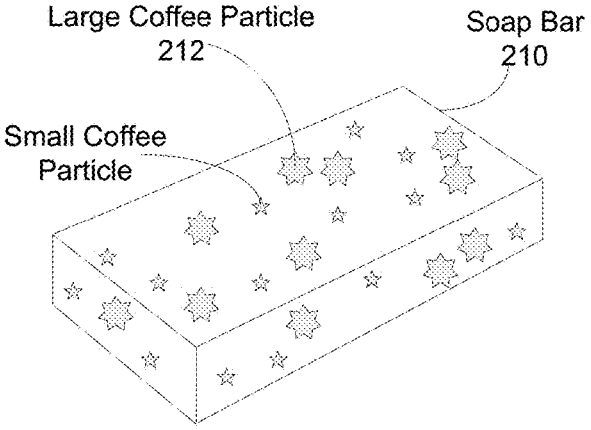

FIGS. 2A-C illustrate soap bars comprising various particle size configurations, according to at least one embodiment. In FIG. 2A, a soap bar 200 may comprise exclusively of a large coffee particle size 202, such as, e.g., 1.0 mm thick particles. A particle size range of 0.21 mm to 6.0 mm may be considered large. The particles may be evenly distributed in the soap, such as shown, or there may be layers comprising particle-positive and particle-negative portions. FIG. 2B is a soap bar 204 comprising exclusively of a small coffee particle size 206, such as, e.g., 0.20 mm thick particles. A particle size range of 0.01 mm to 0.20 mm may be considered small. The particles may be evenly distributed in the soap, such as shown, or there may be layers comprising particle-positive and particle-negative portions. FIG. 2C illustrates a soap bar 208 comprising a mixture of a small coffee particle size 210 and large coffee particle size 212. The ratio of the two sizes may be even, such as a 1:1 ratio, or there may be an imbalance, such as a 1:2 ratio, or a 1:5,000 ratio. Generally, if the content of the large particles is too high, the product may be similar to a product without the small particle size; and if the content of the small particles is too high, the product may be similar to a product without the large particle size. Particle ratio may be predetermined based on one or more desired qualities of the resulting soap product. In addition, the different sizes may be separated such that a portion of the soap bar comprises only a large size and another portion of the soap bar comprise only a small size. In some embodiments, the soap bar may comprise a top portion that comprise only a large particle size and a bottom portion that comprises only a small size such that the two portions comprise different texture qualities.

In some embodiments, the method of the present invention may involve brewing of fresh coffee grounds to produce post-brew coffee grounds that are used for making a molded soap product. Alternatively, post-brew coffee grounds may be acquired from a coffee shop, a deli, a market, a supermarket, or any other location that sells coffee or coffee products. If brewing is required, the method may require hot distilled water, approximately 180 to 200 degrees Fahrenheit, to be under pressure and forced through fine coffee grounds of a small particle size resting in a container, such as a portafilter, for about 20 to 30 seconds. The particle size may be approximately 0.01 mm to 0.20 mm. The coffee beans may be of any variety and of any roast level. The advantage of this brewing method may allow for post-brew coffee grounds that comprise a low moisture level.

However, any brewing method may be used to implement the present invention, as long as post-brew grounds are able to be collected. For example, a brewing method wherein hot distilled water of approximately 180 to 200 degrees Fahrenheit slowly drips onto coffee grounds that are disposed on top of a filter may be used. Another brewing method that utilizes a press to extract the coffee grounds submerged under hot distilled water may also be employed. In addition, a cold brewing method may be used, such that coffee grounds are submerged under cool or cold water, and allowed to brew over a predetermined period of time. The method may include filtering the coffee particles after brewing to separate the coffee beverage content and the coffee ground. These methods, however, may require an additional drying step prior to use for making the soap products, such as, e.g., baking at approximately 100 to 175 degrees Fahrenheit for 2-3 hours, because unwanted moisture content is, in part, the result of the brewing methods. Moisture in post-brew coffee grounds may have the disadvantage of mold growth, which may in turn destroy the final product, and render it unusable.

After brewing of the coffee grounds, the grounds may be collected and the coffee beverage may be consumed or discarded. In other embodiments, the coffee beverage may be added to the soap product to take advantage of its fragrance. If such is the case, the coffee brew may be made high in concentration such that both the color and fragrance of the brew may be reflected in the final product. A predetermined concentration of the coffee brew may used to achieve a predetermined color and/or fragrance intensity. For example, if a the drip method is used to implement the present invention, then the coffee brew may be reheated multiple times, e.g., 2 to 5 times, and re-used to brew new fresh coffee grounds each time. In essence, this will allow for controlling the concentration of the coffee brew that is to be used in the soap product.

In some embodiments, the method of the present invention may involve cooling the post-brew coffee grounds and/or the concentrated coffee beverage, if they are to be added to a strong alkaline solution such as sodium hydroxide or potassium hydroxide (e.g., lye) in a "cold process" method of soap manufacture. Adding hot coffee grounds or coffee brew to the lye may cause an exothermic reaction such that the extra heat produced through saponification may overheat and burn the grounds and/or coffee in the beverage, producing an unpleasant aroma thereafter. Methods to cool the grounds and/or beverage may be either a submersion into an ice bath for at least 2 hours, or refrigeration for at least 4 hours. The final temperature of the grounds and/or coffee beverage may be below 60 degrees Fahrenheit prior to mixing with lye.

Alternatively, if the post-brew coffee grounds are harvested from a coffee vendor, and there is no access to the beverage that resulted from its brew, then a coffee concentrate may be obtained from a third party, e.g., purchased from a market or vendor. The coffee concentrate should also be child to below 60 degrees Fahrenheit prior to mixing with lye. In addition, the collected coffee-grounds may be subjected to a further grinding procedure, if particle size reduction is desired. When the post-brew grounds are at a predetermined size, the grounds may be clumped, therefore, a procedure to break up the clumps may be necessary, such as by using a pistol and mortar, or a vibrating surface.

Figure 3:
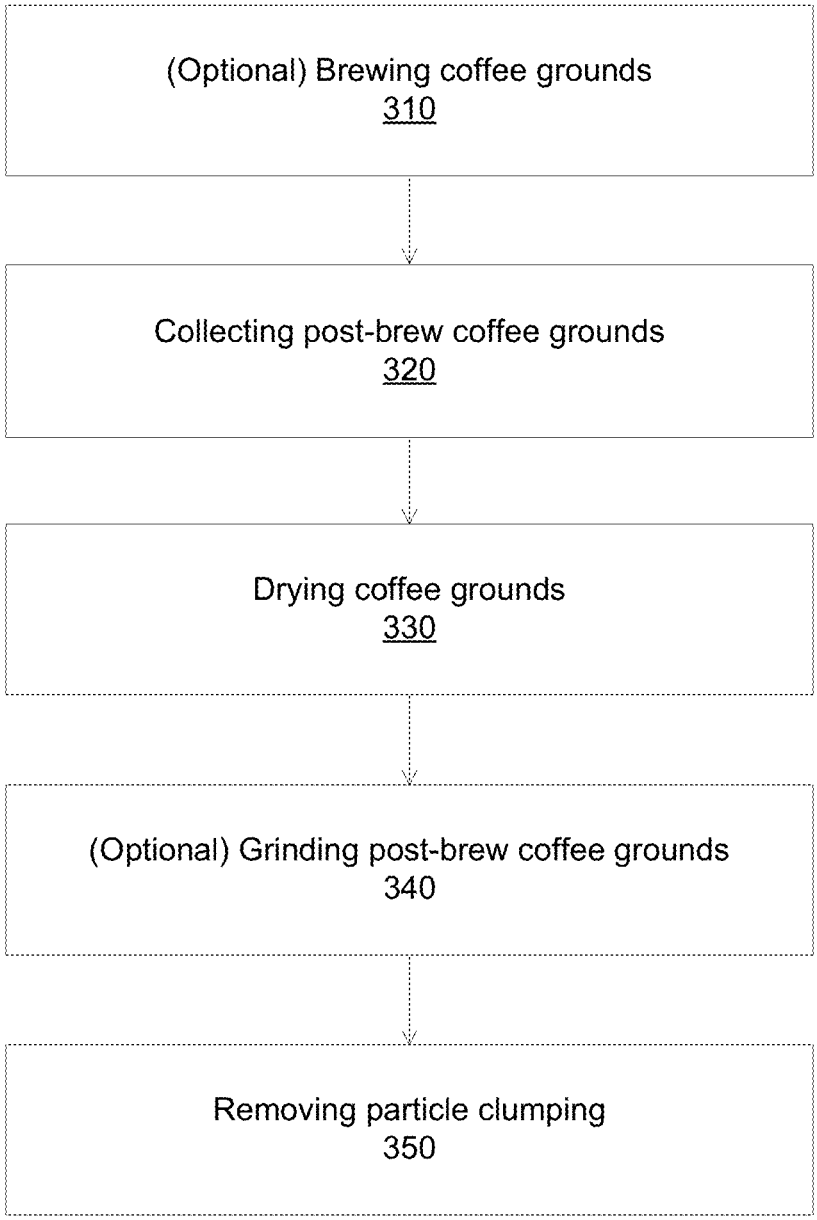
FIG. 3 is a flowchart depicting a method for preparing post-brew coffee grounds to be used in soap production.

FIG. 3 is a flowchart depicting a method for preparing post-brew coffee grounds to be used in soap production. Operation 310 may optionally brew grounded coffee from FIG. 1. A variety of techniques may be used to brew the coffee grounds. The resulting coffee brew beverage may optionally be used as a flavoring compound. In addition, the coffee brew may be re-heated to brew one or more additional batches of fresh coffee grounds to increase concentration, and hence, aroma of the coffee. Operation 320 collects post-brew coffee grounds after brewing of the fresh coffee grounds. In some embodiments, post-brew coffee grounds may be collected from a coffee shop, a deli, a market, a supermarket, or any other location that sells coffee or coffee products, wherein the brewing was performed by the coffee vendor prior to collection. Operation 330 dries the post-brew coffee grounds, if necessary. Depending on the brewing process used and the size of the coffee grounds, the post-brew coffee grounds may comprise moisture content, which may be undesirable. Operation 340 may optionally grind the dry post-brew coffee grounds to achieve a pre-determined size. Operation 350 may remove particle clumping, such as through the use of a pistol and mortar, or a vibrating surface.

In at least one embodiment of the present invention, the method may comprise a melt-and-pour process of manufacturing coffee-ground-infused soap bars. A saponified fat base, e.g., a milk soap base, a plant oil base, and/or an animal fat base may be obtained and heated to a consistency. Examples of milk soap bases include goat's milk, cow's milk, camel's milk, coconut milk, and almond milk. Examples of plant oil bases include avocado oil, cinnamon oil, coconut oil, olive oil, sunflower oil, and nutmeg oil. An example of an animal fat base include a lard soap base. In an exemplary embodiment, the melt-and-pour soap base may comprise the ingredients: glycerin, *elaeis guineensis* oil (palm oil), *cocus nucifera* oil (coconut oil), lauric acid, sodium hydroxide, sodium lauryl sulfate, sorbitol, triethanolamine, sodium chloride (table salt), goat milk, ethylenediaminetetraacetic acid (EDTA), and/or titanium dioxide.

Prior to heating, if the soap base is in solid form, such as a cube, dividing the cube into smaller equal or almost equal portions may increase heating rate due to the increase in surface area to volume ratio of the base, and may facilitate even heating. The soap base may also come in powder form, which may not require prepping. The heating may be performed in a container placed in direct contact with a heating apparatus, e.g., in a pot on a stove, or in a convection oven, such as a microwave oven. If the former is used, continual stirring of the soap base may be required for even heating and to prevent burns, which may have undesirable qualities. If a convection oven is used, stirring should be performed in intervals, such as every 15 seconds or 30 seconds, such that the soap base is evenly heated.

After the saponified fat base reaches a consistency, the collected post-brew coffee grounds may be added. The coffee grounds may be anywhere from 1% to 65% of the total weight of the final product, depending on the desired soap quality. A higher amount of coffee grounds may allow for a shorter soap final product drying and hardening time, but may reduce cleansing effectiveness and increase exfoliation. The opposite is also true, whereby a lower amount of coffee grounds may require a longer soap final product drying and hardening phase, but may increase cleansing effectiveness by allowing the oils and minerals inside the soap to have a greater effect, while exfoliation is decreased. If a final soap product comprising coffee ground positive and coffee ground negative layers or portions is desired, the coffee grounds may be 40% or less of the total weight of the final product when mixed with the soap base, otherwise the portions may separate poorly. The consistency may be achieved when the soap base reaches a constant temperature between 100 degrees Fahrenheit and 160 degrees Fahrenheit such that the base is hot enough to facilitate the distribution of the coffee particles without burning the particles. If even distribution of the coffee particles within the base is desired, continual stirring of the base may be employed. Optionally, a suspension base may be added to maintain the even distribution by suspending the particles within the melted base. This may be particularly useful when the base is poured into a mold and is at rest to harden into a final product.

In some embodiments, alternative methods of infusing the post-brew grounds with the melted base may be provided. For example, if the final soap product is desired to have the effect of layers, wherein different portions of the product comprise different texture qualities, the melted soap base and coffee grounds may not be stirred and may be allowed to settle such that the coffee grounds accumulate towards the lower portion, leaving the top portion with minimal particle contamination. The coffee grounds may be 40% or less of the total weight of the final product when mixed with the soap base, otherwise the portions may separate poorly. The portions may be divided into equal or roughly equal parts. In other embodiments, the portions may be unequal parts, such as having a volume ratio of 1:2, 1:3, or 1:4. The settling of the particles may be achieved by keeping the temperature constant for approximately 10 minutes to 30 minutes. The temperature is ideally on the higher end of the range, such as, e.g. 120 degrees Fahrenheit to 160 degrees Fahrenheit, such that there is adequate enthalpy and entropy in the system to facilitate movement of the particles towards the bottom portion.

Another alternative method may comprise adding the coffee particles to the top surface of the melted soap base after it has cooled to approximately 80 to 120 degrees Fahrenheit. This may be achieved while the soap base is still contained within its heating container, or after it has been poured into molds. A soap product manufactured through this process may achieve the effect of layers wherein only the top portion of the product comprises post-brew coffee grounds. The top portion and the bottom portion may be divided into equal or roughly equal parts. In other embodiments, the portions may be unequal, such as having a height ratio of 1:2, 1:3, or 1:4 relative to the height of the mold. The lower temperature used in this method reduces enthalpy and entropy within the soap base system, limiting downward movement by the coffee particles. In generally, the lower the temperature, the less downward movement of the particles may be observed.

A final alternative method may comprise pre-filling a mold with post-brew coffee grounds prior to pouring melted soap base into the mold for hardening. In this method, the grounds may be filled to any predetermined height level, such as ½, ⅓, or ¼ of the mold height, and thus the final product height. A higher amount of coffee grounds may allow for a shorter soap final product drying and hardening time, but may reduce cleansing effectiveness and increase exfoliation. The opposite is also true, whereby a lower amount of coffee grounds may require a longer soap final product drying and hardening phase, but may increase cleansing effectiveness by allowing the oils and minerals inside the soap to have a greater effect, while exfoliation is decreased. After pouring the base onto the coffee particles, a light stir may be utilized to suspend the particles to reach and maintain a predetermined height. This method may produce a final soap product that comprises a top portion and a bottom portion comprising different texture qualities. For example, the bottom portion at which the coffee grounds are accumulated may have a granular texture quality, and the top portion that is free of the coffee grounds may have a smooth texture quality.

In some embodiments, the method of the present invention may comprise flavoring the melted saponified fat base mixture with one or more fragrance oils. The fragrance oil, e.g., an essential oil, may have the characteristic aroma of the plant or source from which it was extracted, and may be used in conjunction with the above described coffee brew, or it may be the only source of added flavoring. Generally, the amount of fragrance oil that may be added to the mixture can vary depending on the desired fragrance characteristic and intensity, and the characteristic and intensity of other oils to which it may be combined. The fragrance oil may comprise 5% or less of the total weight of the final product.

Alternatively or in addition, the previously brewed coffee beverage or coffee concentrate may be poured and mixed with the soap base, if desired. The preferable amount of coffee brew may be 1% to 33% of the total weight of the melted base. After addition of the fragrance oil and/or coffee brew, stirring may be used to evenly distribute the oil within the base mixture.

The final step of the melt-and-pour coffee-ground soap manufacture process may comprise pouring the base mixture along with the ingredients that were mixed within it into a mold to allow for hardening. The mold may be a container comprising a desired physical form which the final product will resemble, and may be made from any material, such as wood or aluminum.

If bubbles are present on the top surface of the soap mixture while it is resting within the mold, the method may optionally use alcohol, and preferably ethanol, to remove the bubbles. In some embodiments, 1 to 3 spritz of alcohol may be sprayed onto the affected area at a distance of approximately 10 inches to 20 inches. A soft cloth may be used to remove any blemishes that may result, if the product has hardened enough to do so. Although isopropyl alcohol, e.g., rubbing alcohol, may be used, there may be a lingering smell after the product forms. Therefore, ethanol, e.g., Everclear™, is preferable and should be used at either 151 proof (75.5%) or 190 proof (90%), as it is a clear and odorless liquid. However, the present invention is not so limited and other alcohol types, e.g., methanol, and various strengths may also be used.

The product may be given 1 hour to 36 hours to complete its hardening, which may be dependent on the mold size, and may be removed from the mold thereafter. Depending on the mold type, this may be performed by turning the mold upside down. However, if the product is resistant, the mold containing the product may be chilled down to approximately 35 degrees Fahrenheit to 45 degrees Fahrenheit, as this may be the optimal range to increase the product's density and to facilitate shrinkage. If a large mold is used, then the final soap product may be cut into smaller usable pieces.

Figure 4:
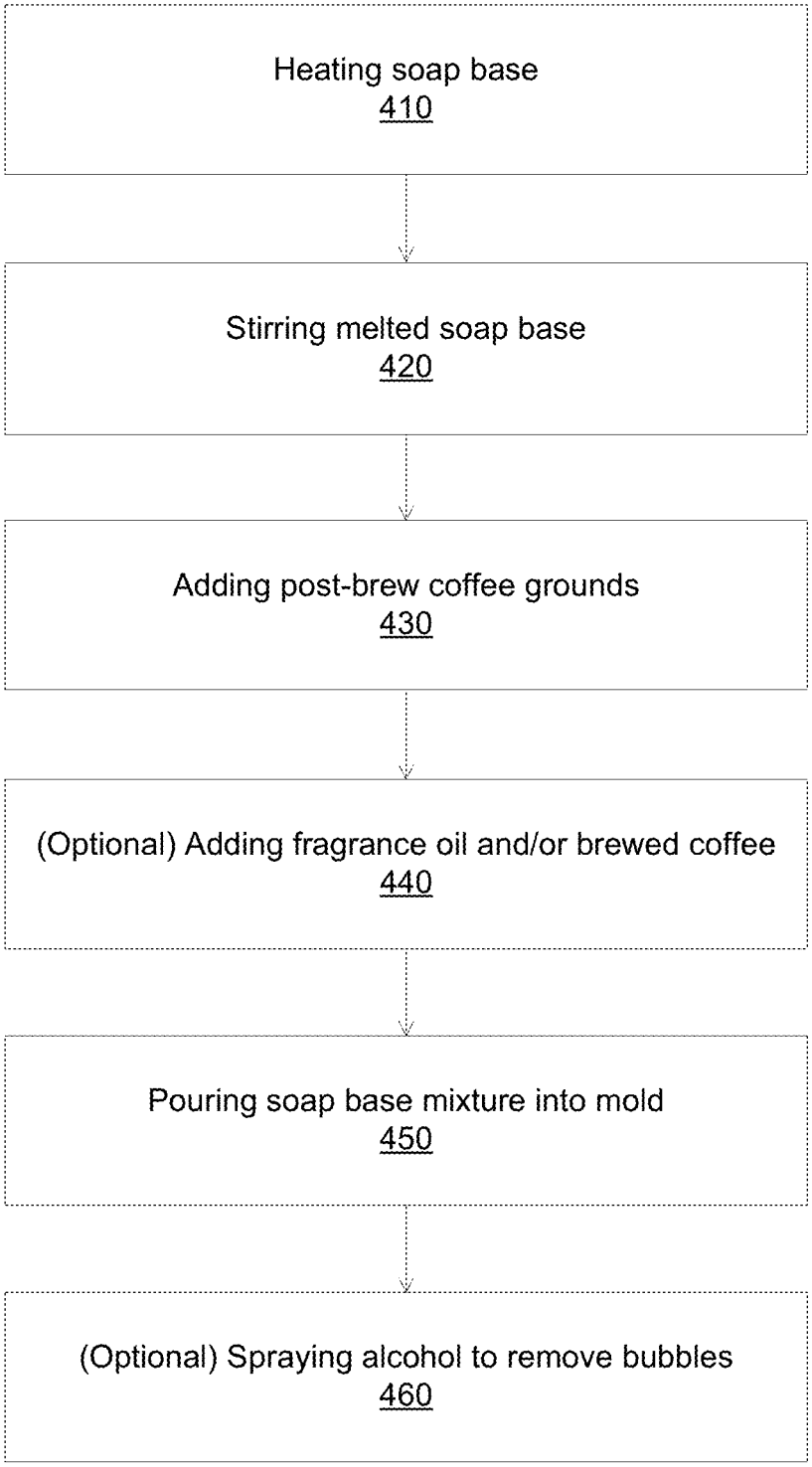
FIG. 4 is a flowchart for manufacturing a post-brew coffee ground soap product, according to at least one embodiment.

FIG. 4 is a flowchart for manufacturing a post-brew coffee ground soap product, according to at least one embodiment. In operation 410, a saponified fat base may be heated to a consistency. The heating may be performed in a container placed in direct contact above a heating apparatus, e.g. a pot on a stove, or in a convection oven, e.g., a microwave oven. Operation 420 continually stirs the base for even heating and to prevent burns, which may have undesirable qualities. Operation 430 may add collected post-brew coffee grounds to the melted soap base. The coffee grounds may be anywhere from 1% to 65% of the total weight of the final product. If a final soap product comprising coffee ground positive and coffee ground negative layers or portions is desired, the coffee grounds may be 40% or less of the total weight of the final product when mixed with the soap base, otherwise the portions may separate poorly. Various techniques of adding the post-brew coffee grounds may be used, depending on the desired soap characteristic. Operation 440 optionally adds fragrance oil to the base mixture. The fragrance oil, e.g., an essential oil, may have the characteristic aroma of the plant or source from which it was extracted. Alternatively or in addition, the previously brewed coffee beverage or coffee concentrate may be poured and mixed with the soap base, if desired. Operation 450 pours the soap base mixture into a mold. The product may be given 1 hour to 3 hours to complete its hardening, which may be dependent on the mold size. The mold may be of any size. If a large mold is used, then the final soap product may be cut into smaller usable pieces after hardening. Operation 460 optionally sprays 1 to 3 spritz of alcohol onto the mold to remove bubbles that may form. Preferably, ethanol is used for its colorless and odorless properties.

Figure 5:
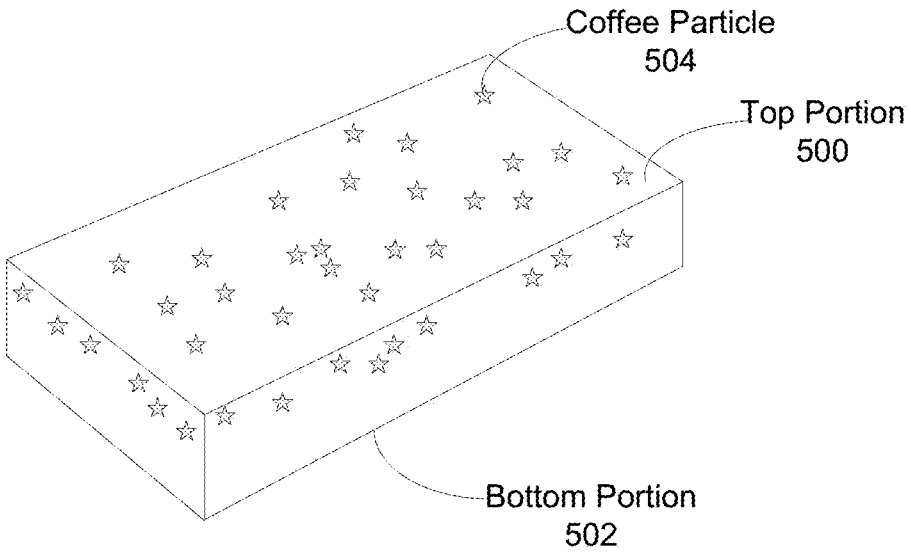
FIG. 5 is a schematic rendition of a soap product formed from a method of the present invention, according to at least one embodiment.

FIG. 5 is a schematic rendition of a soap product formed from a method of the present invention, according to at least one embodiment. The soap bar may be divided into a top portion and a bottom portion. There may be uneven distribution of post-brew coffee ground particles 504 on and within the portions, such that one of the portions may have an accumulation of coffee particles, while the other portion may have minimal or may be completely free of coffee particle contamination. The soap bar as shown may have the benefit of different texture qualities. For example, the portion comprising the coffee particle 504 may be used as a scrub, while the other portion may be used as a cleanser.

In an alternative embodiment, the post-brew coffee grounds are not mixed with the melted base solution during the heating phase. Instead, after the melted base along with any essential oil is poured into the mold at a predetermined height to form a first layer, a thin layer of approximately 1 cm to 2 cm of post-brew coffee grounds are evenly distributed on the top surface of the first layer after it has settled and began to harden. A second layer of the base mixture is then added on top of the layer of coffee grounds such that the coffee grounds are sandwiched between the two base layers. In some embodiments, multiple layers of the coffee grounds may be incorporated in a soap bar, e.g., 2-3 layers of coffee grounds. The final soap product produced in this method may comprise coffee-grounds-free cleansing surfaces separated by one or more thin layers of coffee grounds for its aroma and therapeutic effects.

Figure 6A:
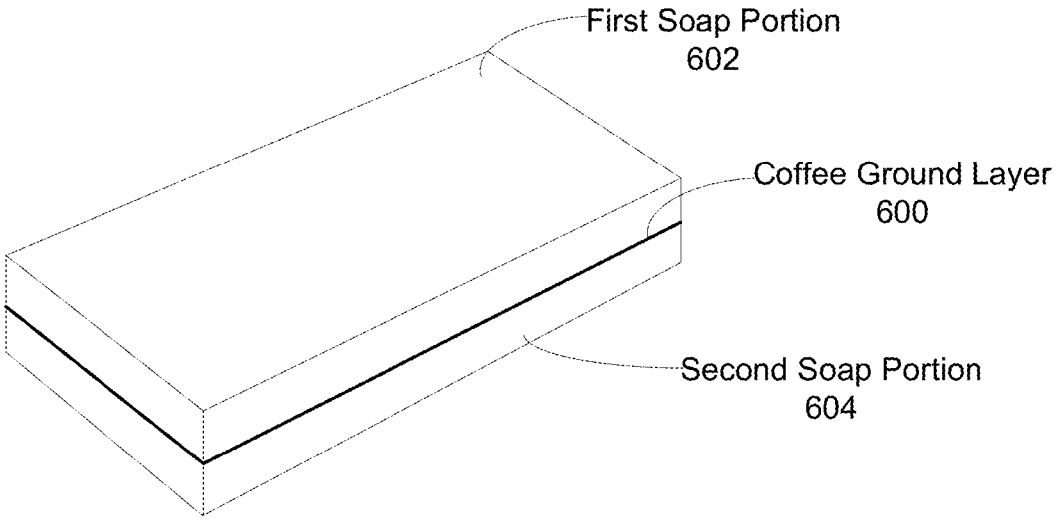
FIGS. 6A-B are schematic renditions of various configurations for a final soap product, according to some embodiments.
Figure 6B:
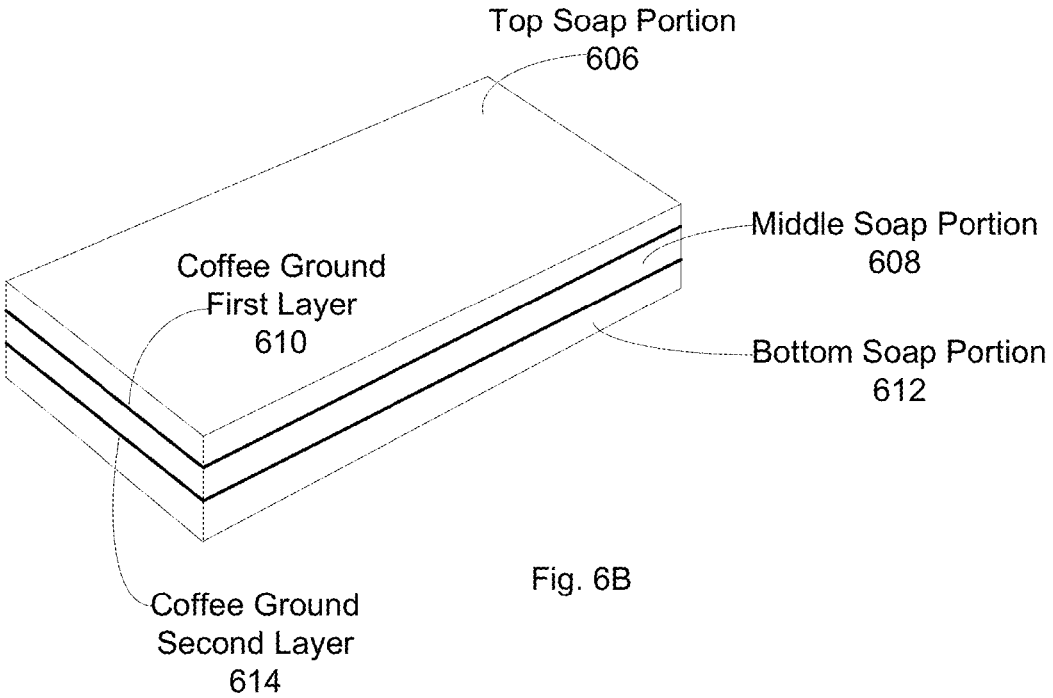

FIGS. 6A-B are schematic renditions of various configurations for a final soap product, according to some embodiments. In FIG. 6A, a coffee ground layer 600 may comprise collected post-brew coffee grounds, and may be sandwiched between a first soap portion 602 and a second soap portion 604. The post-brew coffee grounds layer may be of any thickness, such as 1 cm to 3 cm thick. The layer may be evenly dispersed along the plane on which is rests. Additionally, the layer may comprise patterns, for example, such that a cross section of the soap product comprises a wave or sinusoidal shape. FIG. 6B shows a soap product comprising two layers of coffee grounds, however, there may be additional layers. As shown, a top soap portion 606 and a middle soap portion 608 may surround a coffee ground first layer 610. The middle soap portion 608 and a bottom soap portion 612 may surround a coffee ground second layer 614. The height of each soap portion may be equal, or they may vary. The thickness of the coffee ground layers may also be equal, or they may vary. The coffee ground layers may range from 1 cm to 3 cm thick. The coffee ground layers may also comprise patterns, for example, such that their cross section comprise a wave or sinusoidal shape.

In some embodiments of the invention, the process of manufacturing post-brew coffee ground soap products may comprise a "cold process" method. The method may require mixing a lye (sodium hydroxide or potassium hydroxide) solution with a lipid (oil and/or animal fat and/or milk) to induce saponification, which is an exothermic chemical reaction that produces soap, glycerin, heat as byproducts. The lye solution may comprise distilled water and optionally the aforementioned milk. The water and/or milk may be chilled or frozen prior to adding lye to reduce the chance for a violent chemical reaction. Milk may be obtained in powder form, whereby a mixture with distilled water may be required prior to chilling.

The method may also comprise heating and mixing soap making oil, e.g., palm oil and/or animal fat, e.g., lard, and/or milk, e.g., goat's milk, prior to mixing with the lye. More than one type of oil, fat, and/or milk may be used, depending on the desired quality of the final soap product. A hardening solution may be used wherein the solution facilitates hardening of the soap product. Precise amounts of each ingredient of both mixtures may be calculated using a lye calculator. The lye solution may be added to the soap making oil/fat/milk mixture after both solutions have cooled to approximately 90 to 125 degrees Fahrenheit. An ice bath may be used to speed the rate of cooling of both solutions. Continual stirring may be employed to facilitate even heating of the combined mixture.

The collected post-brew coffee grounds may begin to be added when the mixture reaches the onset of trace. In some embodiments, the method may allow testing for the presence of trace by removing half a teaspoon full of the mixture and applying it to its surface. If the applied content stays afloat for 2 or more seconds, then the mixture may be considered at trace. Fragrance oil and/or coffee brew may also be added at this point, if desired. The post-brew coffee grounds may be added to the mixture in a number of methods. The coffee grounds may be anywhere from 1% to 65% of the total weight of the final product, depending on the desired soap quality. A higher amount of coffee grounds may allow for a shorter soap final product drying and hardening time, but may reduce cleansing effectiveness and increase exfoliation. The opposite is also true, whereby a lower amount of coffee grounds may require a longer soap final product drying and hardening phase, but may increase cleansing effectiveness by allowing the oils and minerals inside the soap to have a greater effect, while exfoliation is decreased. If a final soap product comprising coffee ground positive and coffee ground negative layers or portions is desired, the coffee grounds may be 40% or less of the total weight of the final product when mixed with the soap base, and then allowed to settle, otherwise the portions may separate poorly.

In one method, if even distribution of the grounds within the final soap product is desired, then the addition of the coffee grounds may be followed with continual stirring for even heating and distribution. Optionally, a suspension base may be added to maintain the even distribution by suspending the particles within the melted base. This may be particularly useful when the base is poured into a mold and is at rest to harden. In this method, a medium trace may be achieved with the mixture prior to adding the coffee grounds. The medium trace may be observed when the applied content stays afloat for 4 seconds to 6 seconds. The mixture may then be poured into a mold to allow for hardening from 1 hour to 36 hours.

In another method, the coffee grounds may be poured into a mold to a predetermined height, such as ½, ⅓ or ¼ of the height of the mold, and hence the final product. The saponified fat mixture may be poured over the coffee grounds. This method may produce a final soap product that comprises a top portion and a bottom portion comprising different texture qualities. For example, the bottom portion at which the coffee grounds are accumulated may have a granular texture quality, and the top portion that is free of the coffee grounds may have a smooth texture quality.

In a final alternative method, coffee particles may be added to the top surface of the saponified fat mixture after it has been poured into a mold. A soap product manufactured through this process may also achieve the effect of layers wherein only the top portion of the product comprise post-brew coffee grounds. The top portion and the bottom portion may be divided into equal or roughly equal parts. In other embodiments, the portions may be unequal parts, such as having a height ratio of 1:2, 1:3, or 1:4. In general, the heavier the trace prior to the addition of the coffee grounds, the less downward movement of the grounds may be observed. A medium, e.g., 4 seconds to 6 seconds, or a heavy trace, e.g., 6 seconds or more, may be favorable in this method to ensure separation of the portions.

After the mixture has been transferred to the mold, the final soap product may be allowed up to 36 hours to cure and harden. The post-brew coffee grounds within the product may allow for a faster cooling time than normally required due to the added porosity and increase in surface area of the product. The mold may be a container comprising a desired physical form which the final product will resemble, and may be made from any material, such as wood or aluminum. The mold may be of any size. If a large mold is used, e.g., 12 inches by 12 inches by 3 inches, then the final soap product may be cut into smaller usable pieces after hardening.

If bubbles are present on the top surface of the soap mixture while it is resting within the mold, the method may optionally use alcohol, and preferably ethanol, to remove the bubbles. In some embodiments, 1 to 3 spritz of alcohol may be sprayed onto the affect area at a distance of approximately 10 in. to 20 in. A soft cloth may be used to remove any blemishes that may result, if the product has hardened enough to do so. Although isopropyl alcohol, e.g., rubbing alcohol, may be used, there may be a lingering smell after the product forms. Therefore, ethanol, e.g., Everclear™, is preferable and should be used at either 151 proof (75.5%) or 190 proof (90%), as it is a clear and odorless liquid. However, the present invention is not so limited and other alcohol types, e.g., methanol, and various strengths may also be used.

Figure 7:
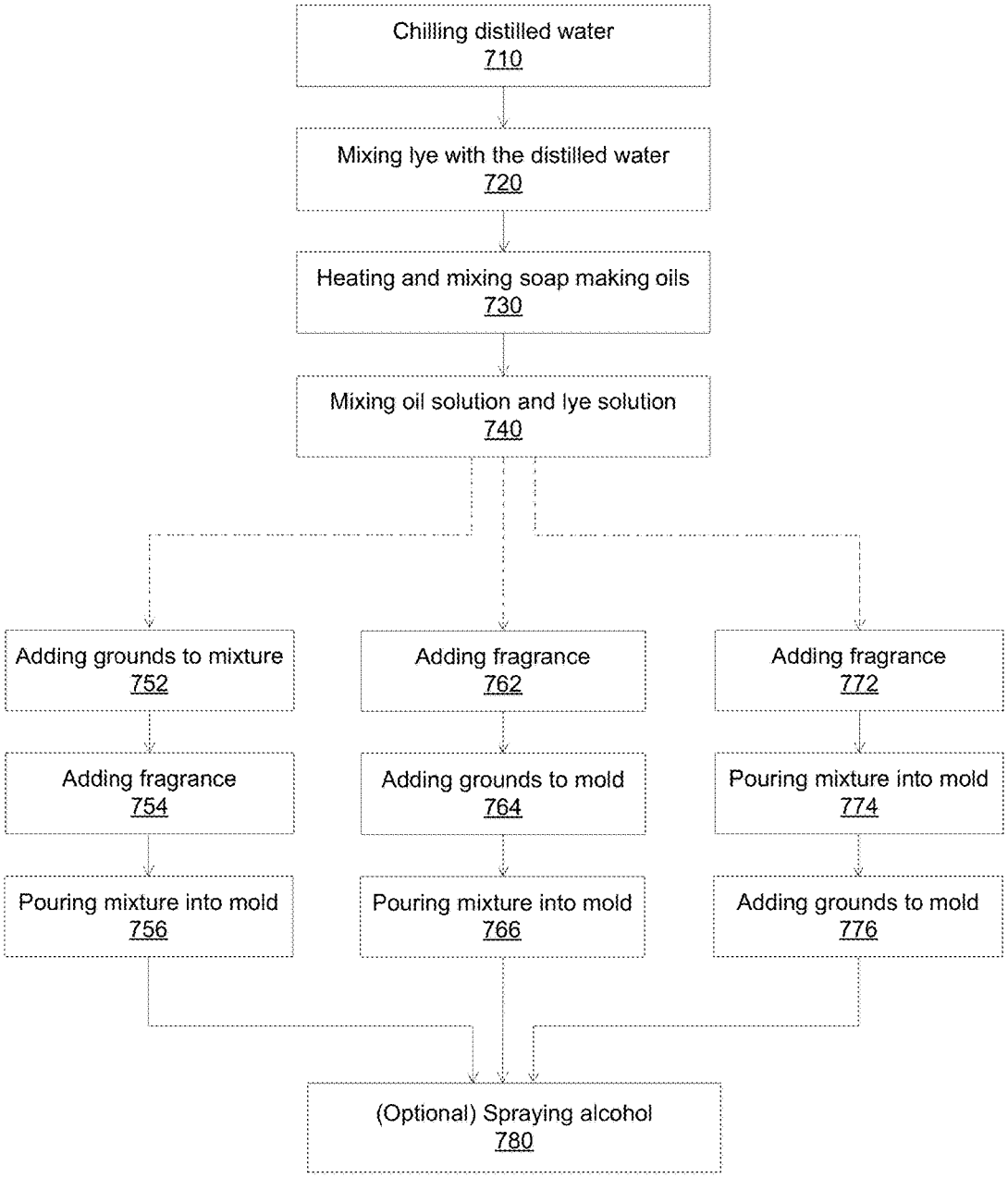
FIG. 7 is a flowchart of a method for making a soap product comprising post-brew coffee grounds, according to at least one embodiment.

FIG. 7 is a flowchart of a method for making a soap product comprising post-brew coffee grounds, according to at least one embodiment. Operation 710 chills distilled water and/or milk, which may be used to mix with lye, e.g., sodium hydroxide or potassium hydroxide. Milk may be obtained in powder form, whereby a mixture with distilled water may be required prior to chilling. An ice bath or refrigeration may speed the rate of cooling. Operation 720 mixes lye with the distilled water and/or milk. An exothermic chemical reaction may occur whereby heat is produced. Continual stirring may facilitate heat dissipation and even mixing. In operation 730, soap making oils, e.g., palm oil, coconut oil, and/or animal fat, e.g., lard, and/or milk, e.g., camel's milk, may be heated and mixed together. Operation 740 mixes the soap making oil/fat/milk solution with the lye solution. The method may require cooling both mixtures to approximately 100 degrees Fahrenheit to 125 degrees Fahrenheit prior to mixing.

After operation 740, the method may be divided into three alternative methods, depending on the desired characteristic of the final soap product. If a soap product comprising even distribution of post-brew coffee ground is desired, then operation 752 adds the coffee grounds to the mixture at the onset of trace. Stirring may be used to facilitate even distribution of the grounds within the mixture. Operation 754 adds fragrance to the mixture. A fragrance oil and/or brewed coffee beverage may be used. Operation 756 pours the mixture into a mold for hardening into the final product from 1 hour to 36 hours. The mold may be a container comprising a desired physical form which the final product will resemble, and may be made from any material, such as wood or aluminum. The mold may be of any size. If a large mold is used, e.g., 12 inches by 12 inches by 3 inches, then the final soap product may be cut into smaller usable pieces after hardening.

In an alternative method, if a soap product comprising separate portions comprising different texture qualities is desired, operation 762 adds fragrance to the oil and lye mixture. A fragrance oil and/or brewed coffee beverage may be used. Operation 764 adds post-brew coffee grounds to a mold to a predetermined height of the mold. The predetermined height may be expressed as a ratio, such as ½, ⅓, or ¼ of the height of the mold. Operation 766 pours the mixture into the mold comprising the coffee grounds. The mixture may be allowed 1 hour to 36 hours to cure and harden into a final soap product. If a large mold is used, then the final soap product may be cut into smaller usable pieces after hardening. This method produces a soap bar comprising a bottom portion of granular texture quality, and the top portion of a smooth texture quality.

An alternative method of making a soap bar comprising multiple texture qualities adds fragrance oil to the soap making oil/fat/milk and lye solution in operation 772. A chilled coffee brew beverage may be used in addition to or in substitute of the fragrance oil. Operation 774 pours the mixture into a mold to allow for hardening of the final product from 1 hour to 36 hours. The mold may be a container comprising a desired physical form which the final product will resemble, and may be made from any material, such as wood or aluminum. If a large mold is used, then the final soap product may be cut into smaller usable pieces after hardening. Operation 776 adds post-brew coffee grounds to the top surface of the mixture resting inside the mold. The coffee grounds may be added in the early stages of product hardening, such as within the first 3 hours. A soap product manufactured through this process may also achieve the effect of layers wherein only the top portion of the product comprise post-brew coffee grounds. The top portion and the bottom portion may be divided into equal or roughly equal parts. In other embodiments, the portions may be unequal parts, such as having a height ratio of 1:2, 1:3, or 1:4. In general, the heavier the trace prior to the addition of the coffee grounds, the less downward movement of the grounds may be observed. A medium trace, e.g., 4 seconds to 6 seconds, or a heavy trace, e.g., 6 seconds or more, may be favorable in this method to ensure separation of the portions.

Finally, operation 780 optionally sprays 1 to 3 spritz of alcohol onto the mold to remove bubbles that may form. Preferably, ethanol is used for its colorless and odorless properties.

In at least one embodiment, the present invention discloses a system and a method of making whipped soap. The whipped soap product may be of a creamy texture and may comprise an even distribution of post-brew coffee grounds. The coffee grounds may be regular sized grounds, or espresso grounds; however, regular sized grounds are preferred due to its moisture content (unlike with soap bars described above), which allows the method to require less water by economically utilizing the water already present in the collected grounds. In addition, the regular sized coffee grounds gives the soap a coarse texture that aids in exfoliation and cleaning, unlike espresso grounds, which may produce a texture similar to that of fine sand. However, the invention is not so limited and a mixture of regular sized grounds and espresso grounds may be used, such as in a 1:1 ratio or a 1:2 ratio. The product may replace micro-beads that were once used in care products that are now banned in the states.

Figure 8:
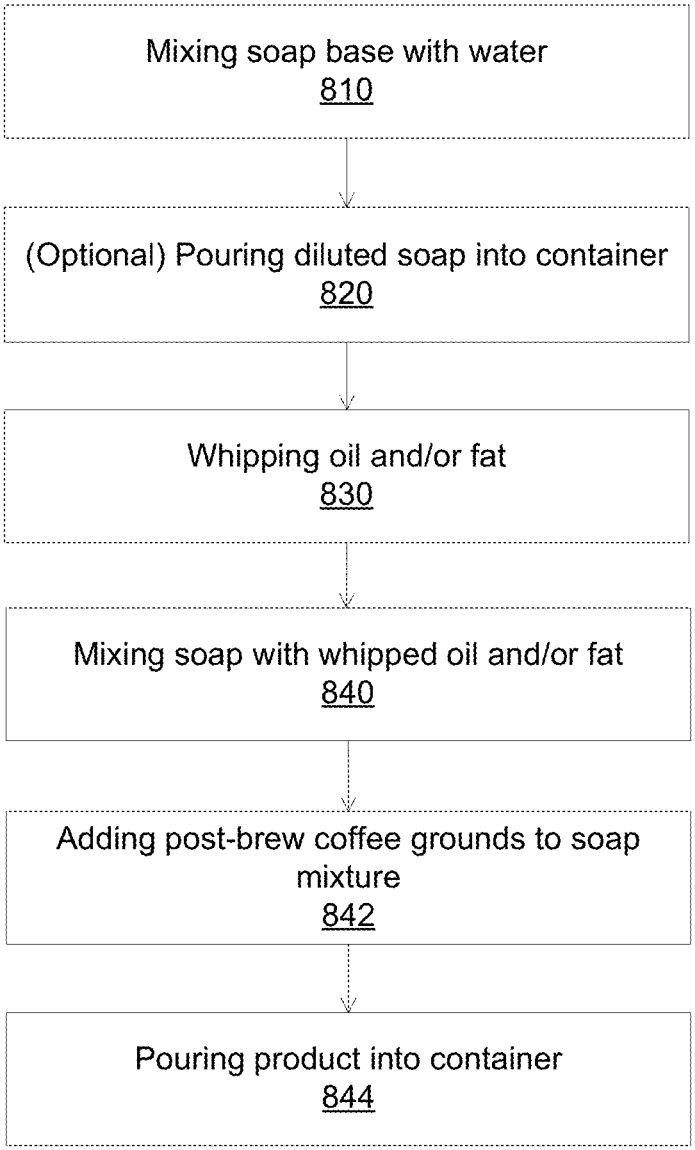
FIG. 8 is a flow diagram of a method for making a whipped soap product, according to at least one embodiment.

FIG. 8 is a flow diagram of a method for making a whipped soap product, according to at least one embodiment. In operation 810, a soap base may be mixed and diluted with water. The soap base may be any variety of soap bases, such as a melt-and-pour soap base, e.g., goat's milk base, or it may be a liquid soap base that does not require melting to liquefy. Approximately, a 3:1 ratio of soap to water may produce a desirable texture of the final product, and may be mixed in a container for heating. Operation 820 optionally pours the heated diluted soap into a container for cooling. The product may comprise a gel-like form after it has cooled to room temperature. Operation 830 whips oil and/or fat together to a predetermined texture quality in a separate container while the soap mixture cools. However, the method may allow for additional heating of the soap mixture if the soap has hardened beyond a predetermined hardness level. Any kind of oil may be used, such as coconut oil and palm oil, and any kind of fats may be used, such as vegetable fat, e.g., Shea Buter and cocoa butter. Operation 840 mixes soap with the whipped oil and/or fat, and operation 842 adds the post-brew coffee grounds to the mixture. The content by volume of the grounds may be 5-50% of the final product. It may be desirable to add the coffee grounds at this stage as the soap mixture is in a liquefied state, because the moisture present in the collected coffee grounds may be utilized, creating for an economical and green method of production. Finally, operation 844 pours the mixture product into a container to allow for cooling. The resulting product may comprise primarily soap, post-brew coffee grounds, shortening and/or oil.

In at least one embodiment, the present invention discloses a system and a method for making a candle comprising post-brew coffee grounds. The post-brew coffee grounds may be infused with candle wax material and may be positioned at a lower portion of the candle. In other embodiments, the coffee grounds are not infused with the candle wax, and are simply positioned below the wax inside a container. The coffee grounds may provide the benefit of acting as a flame retardant to safely put out a flame front, and may aid in the cleaning of the container in which it is disposed. The container may then be re-used.

Figure 9:
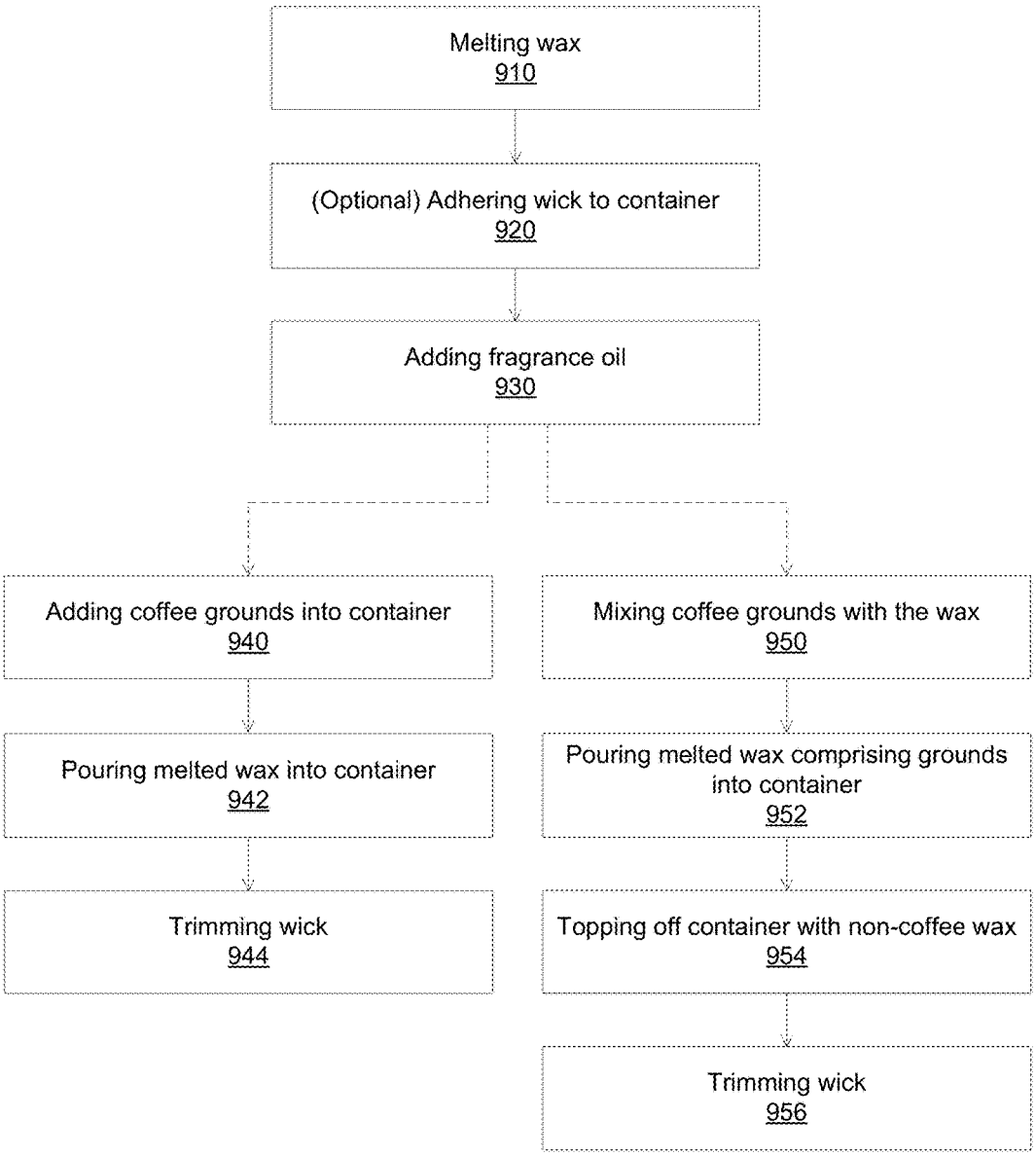
FIG. 9 is a flowchart of a method for making a candle comprising post-brew coffee grounds, according to at least one embodiment.

FIG. 9 is a flowchart of a method for making a candle comprising post-brew coffee grounds, according to at least one embodiment. In operation 910, candle wax may be melted in a container, such as a boiler or pan at approximately 150 degrees Fahrenheit to 180 degrees Fahrenheit. Continual stirring may allow for even heating of the wax. The wax may be any type of candle wax, such as paraffin, soy, and/or beeswax. Operation 920 adheres a wick to a container in which the candle will be situated. The wick may optionally be attached to the container by placing an adhesive material from one end of the wick to the bottom of the container. Wax may alternatively be melted on top of an end portion of the wick to keep it stationary. However, the wick need not be adhered to the container at all. For example, while one end of the wick is attached to the bottom of the container (or it may be free-hanging), the other end may be secured, e.g., taped or wrapped, to a beam, such as a pencil or stick, placed directly above the opening of the container. A centering device may alternatively be used. The entire length of the wick may be centered along a middle axis of the container to facilitate proper burning of the wax.

After the wax has completely melted, operation 930 may add fragrance to the wax. The fragrance may be fragrance oil and/or a brewed coffee beverage and may add an aroma to the candle. The melted wax and fragrance oil may be stirred for even distribution.

Next, post-brew coffee grounds may be added to the final candle product in alternative methods. In a first method whereby the coffee grounds are positioned below the wax of a final product, operation 940 adds the coffee grounds to the bottom of the container to a predetermined height. Operation 942 then pours the melted wax into the container comprising the coffee grounds and wick. Any type of container may be used, such as a Mason jar, coffee mug, or glassware. The melted wax mixture may be cooled to approximately 130 degrees Fahrenheit to 140 degrees Fahrenheit prior to it being poured into the container. Operation 944 trims the wick to a desired height above the top surface of the candle, such as ¼ inch.

Alternatively, coffee grounds may be infused with the candle wax. In such case, operation 950 mixes coffee grounds with a small portion of the wax. The small portion may be a predetermined portion coinciding with a predetermined height of the coffee-infused wax portion. Operation 952 then pours the melted wax comprising the grounds into the container. Operation 954 tops off the container with the wax that does not contain coffee grounds. Operation 956 trims the wick to a desired height above the top surface of the candle, such as ¼ inch.

Figure 10A:
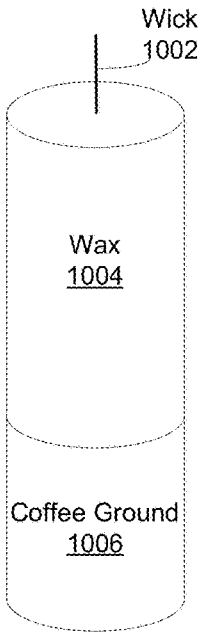
FIGS. 10A-C are schematic diagrams of a candle comprising post-brew coffee grounds, according to at least one embodiment.
Figure 10B:
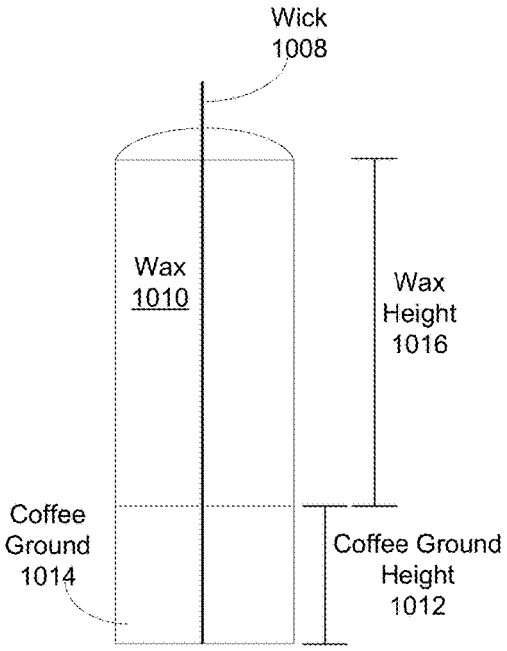
Figure 10C:
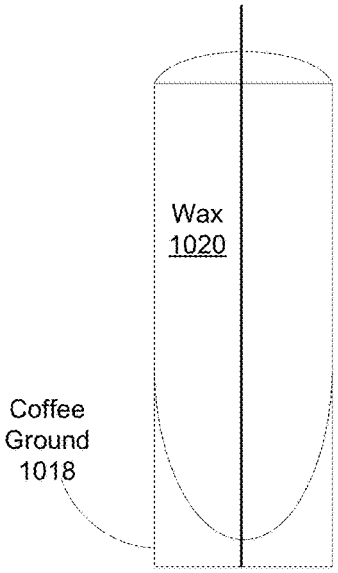

FIGS. 10A-C are schematic diagrams of a candle comprising post-brew coffee grounds, according to at least one embodiment. FIG. 10A is a perspective view of a candle comprising a wick 1002, a wax portion 1004, and a coffee ground portion 1006. The post-brew coffee grounds may be infused with the wax 1004, such as forming part of the wax portion 1004, or it may be a separate portion positioned below an upper wax portion 1004. FIG. 10B is a vertical cross-section of the candle comprising coffee grounds. A wick 1008 may extend from the base of the container wherein the candle is positioned to approximately a quarter of an inch above the top surface of a wax portion 1010. A coffee ground height 1012 of a coffee ground portion 1014 may be predetermined to be at any height relative to a wax height 1016 of the wax portion 1010, such as ⅓, ¼, ⅕, or less. The coffee ground portion 1014 may take the shape of the candle such that its horizontal cross section matches with the wax portion 1010's horizontal cross section. The coffee ground portion's top surface may be flat. In FIG. 10C, a vertical cross-section of an alternative configuration of the candle is presented, showing a concave shape top surface. A coffee ground portion 1018 may not match the shape of a wax portion 1020, and may comprise a circumferential wall with a dip in its center. This configuration may allow the flame front of the wick to be surrounded by a wall of coffee grounds as the wax vaporizes, and may allow for a safe extinguishment of the flame.

In some embodiments, the present invention discloses a system and a method for making a concreate table from post-brew coffee grounds and concrete.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method, comprising:

melting a soap base, wherein the soap base comprises at least one of a milk product, an oil, and a fat;

adding post-brew coffee grounds to the soap base;

adding fragrance to the soap base, wherein the fragrance comprise 5% or less of the total weight of the fragrance and soap base mixture;

pouring the soap base into a mold, and wherein the mixture is permitted to harden from 1 to 36 hours.

2. A method of claim 1, further comprising:

wherein the post-brew coffee grounds are evenly distributed within the soap base.

3. A method of claim 1, further comprising:

wherein the post-brew coffee grounds comprise 40% by weight of a final product.

4. A method of claim 1, further comprising:

wherein the post-brew coffee grounds is 1% to 65% post-brew coffee grounds by weight of the soap bar.

5. A method of claim 1, further comprising:

wherein the soap base comprises glycerin, elaeis guineensis oil, cocus nucifera oil, lauric acid, sodium hydroxide, sodium lauryl sulfate, sorbitol, triethanolamine, sodium chloride, goat milk, ethylenediaminetetraacetic acid (EDTA), and titanium dioxide.

6. A method, comprising:

mixing water with lye, wherein the water is chilled;

adding at least one of an oil, a fat, and a milk product to the water and lye mixture, wherein the oil, fat, and milk is heated prior to adding to the mixture;

adding fragrance to the mixture;

adding post-brew coffee grounds to a mold to a predetermined height, and wherein the predetermined height is ⅓ of the mold.

7. A method of claim 6, further comprising:

pouring the mixture into the mold comprising coffee grounds, and wherein the mixture is permitted to harden from 1 to 36 hours.

8. A method of claim 7, further comprising:

spraying alcohol onto a top surface of the harden mixture, and wherein the alcohol comprises ethanol.

9. A method of claim 8, further comprising:

wherein a final soap bar product comprises a bottom portion of granular texture quality, and a top portion of a smooth texture quality.

10. A method of claim 9, further comprising:

wherein the bottom portion and the top portion comprises a sinusoidal shape.

* * * * *